US006315061B1

(12) United States Patent
Boatman et al.

(10) Patent No.: US 6,315,061 B1
(45) Date of Patent: Nov. 13, 2001

(54) BRINE-BASED DRILLING FLUIDS FOR BALLAST TANK STORAGE

(75) Inventors: Charles Boatman; Brent Estes, both of Houston; Leonard Morales, Missouri City, all of TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/294,758

(22) Filed: Apr. 19, 1999

Related U.S. Application Data

(60) Provisional application No. 60/099,213, filed on Sep. 4, 1998.

(51) Int. Cl.[7] ..... E21B 7/00
(52) U.S. Cl. ..... 175/5; 175/6
(58) Field of Search ..... 175/5, 6, 207; 166/350, 358; 405/195.1

(56) References Cited

U.S. PATENT DOCUMENTS 3,642,063 * 2/1972 Jergins ..... 166/353
3,771,481 11/1973 Goren et al. .
4,062,313 12/1977 Stram .
4,502,551 * 3/1985 Rule et al. ..... 175/6
4,808,036 * 2/1989 Bhalaik et al. ..... 405/217
4,966,495 10/1990 Goldman .
5,706,897 * 1/1998 Horton, III ..... 166/359

FOREIGN PATENT DOCUMENTS

2310634 A 9/1997 (GB) ..... B63B/35/44
2195685 A 4/1988 (GB) ..... C09K/7/06

* cited by examiner

*Primary Examiner*—Frank S. Tsay
(74) *Attorney, Agent, or Firm*—Craig W. Roddy; Karen B. Tripp

(57) ABSTRACT

Drilling fluids are stored in the ballast compartments of drilling vessels to reduce the dependency of a drilling operation on the supply of drilling fluids from work boats. The composition of the brine-based drilling fluid stored in the ballast compartment is designed to provide a biostatic environment and a density appropriate for the environment in which the well is to be drilled.

20 Claims, No Drawings

BRINE-BASED DRILLING FLUIDS FOR BALLAST TANK STORAGE

RELATED APPLICATION

This application claims priority to U.S. Provisional Patent Application Ser. No. 60/099,213 filed Sep. 4, 1998.

TECHNICAL FIELD OF THE INVENTION

The present invention relates in general to abrine-based drilling fluid and methods for storing such fluids on drilling vessels, and more specifically to storing brine-based drilling fluids in drilling vessel ballast tanks.

BACKGROUND OF THE INVENTION

For may years petroleum companies concentrated on developing oil and gas fields on land. But the world's appetite for energy sources, coupled with diminishing returns from land drilling, has driven petroleum companies to develop offshore reserves.

Sub-sea geologic sediments and structures are often similar and in some cases superior to geologic conditions that have proven highly productive on land. In fact, offshore reserves have been estimated at 21% of the world's proven reserves, with estimates that 40% to 50% of all future resources will come from offshore reserves.

A need exists for a method to store sufficient quantities of drilling fluids on a drilling vessel to reduce the dependency of a drilling operation on supplies brought in by work boats, thereby ensuring uninterrupted drilling in the event of inclement weather.

A further need exists for drilling fluid compositions suitable for storage on a drilling vessel.

Drilling offshore wells in deep water, greater than 1000 feet in depth, creates its own set of problems. When drilling on the edge of the continental shelf, quite frequently pressured shallow depth sands, of apparently artesian flow, are encountered. The depth of these sands and the pressures that they exhibit create a unique well design situation.

The unique well design is the result of being unable to hydrostatically control the shallow water flows (SWF) by the conventional method of returning the drilling fluid to the drilling rig. The hydrostatic head generated by returning the fluid to the rig exceeds the fracture gradients of the rock above the SWF. Therefore, the well is designed in a manner that a fluid of the proper density returns only to the sea floor, riserless drilling.

In a riserless drilling situation, large volumes of drilling fluid are required due to the fact that the fluid is not returned to the rig and reused. Depending upon the depth of SWF, volumes from 10,000 to over 30,000 bbls of drilling fluid could be required. The surface mixing equipment of existing rigs is insufficient to store or prepare the large volumes of fluids required to drill riserless. To date, riserless drilling operations have been dependent upon work boats and barges to store and transport the required fluids that were prepared at land based facilities. Often, bad weather has interrupted the supply of work boats and therefore the supply of drilling fluid, causing the termination of drilling operations.

SUMMARY OF THE INVENTION

The invention contemplates a system for storing, mixing and pumping drilling fluids on drilling vessels such as deep water rigs.

In accordance with one aspect of the invention, a process for storing drilling fluids on a drilling vessel is provided including preparing a drilling fluid suitable for ballast tank storage, transporting the drilling fluid to a drilling vessel, pumping the drilling fluid into at least one ballast tank compartment of the drilling vessel, and trimming the drilling vessel during the addition of the drilling fluid.

In accordance with another aspect of the invention, a drilling fluid is prepared, transported to a drilling vessel, pumped into a ballast tank compartment of the drilling vessel for storage until the drilling operation begins, removed from the ballast tank compartment, mixed with solid particulate matter and pumped into the wellbore during drilling.

The stored drilling fluid will be designed (1) to contain no undissolved solids, (2) to be rheologically stable, (3) to be biostatic, (4) to be capable of suspending particulate matter that is added in the drilling operation, and (5) to provide density through dissolved solids.

The foregoing has outlined, rather broadly, aspects of the present invention in order that the detailed description of the invention that follows may be better understood. Additional features and advantages of the system for storing, mixing and pumping drilling fluids on a drilling vessel will be described hereinafter which forms the subject of the claims of the invention. It should be appreciated by those skilled in the art that the concept and the specific embodiment disclosed may be readily utilized as a basis for modifying or designing other processes or compositions for carrying out the same purpose of the present invention. It should also be realized by those skilled in the art that such equivalent constructions do not depart from the spirit and scope of the invention as set forth in the appended claims.

DETAILED DESCRIPTION OF THE INVENTION

The present invention provides a process for storing drilling fluids in ballast tanks of drilling vessels and drilling fluid formulations suitable for ballast tank storage.

As petroleum companies have turned to developing offshore oil and gas reserves, they have been faced with a number of problems. For example, a number of offshore wells have been lost due to shallow water flows.

The use of weighted drilling fluids during the drilling of offshore wells would be helpful in controlling shallow water flows. A drilling fluid is a liquid circulated through the wellbore during rotary drilling operations. In addition to its function of bringing cuttings to the surface, drilling fluid cools and lubricates the bit and drill stem, protects against blowouts by holding back subsurface pressures, and deposits a mud cake on the wall of the borehole to prevent loss of fluids to the formation. Drilling fluids are formulated to maintain the hydrostatic pressure within the wellbore necessary to prevent shallow water flows into the wellbore.

Drilling fluids are used throughout the drilling process. A drilling operation requires a large quantity of drilling fluid (10,000 to 30,000 barrels) to complete the operation. Such large quantities of drilling fluid present a problem for offshore drilling operations, since the drilling fluid is typically supplied by work boats or barges bringing the drilling fluid from land out to the drilling vessel. However, bad weather can interrupt the supply of work boats and therefor the supply of drilling fluid to the drilling vessel.

Whenever the supply of drilling fluid is terminated, the drilling must cease until the drilling fluid supply is once again available. Interrupted drilling operations require a larger overall quantity of drilling fluid, than uninterrupted drilling operations and such interruptions can put the well at risk of shallow water flows. The present invention addresses this problem by storing sufficient drilling fluid on the drilling vessel to reduce the dependency of a drilling operation on supplies brought in by work boats, thereby ensuring uninterrupted drilling in the event of inclement weather.

A number of drilling vessels (such as floating mini-tension leg platforms like the SeaStar™, floating production systems with semi-submersible drilling and production equipment, tension leg platforms, and SPAR™ platforms, and drillships) are designed with ballast tanks that are filled with fluid to provide platform stability. The ballast tanks are typically filled with sea water and the water level raised or lowered as necessary to trim the platform.

One embodiment of the present invention utilizes ballast tanks of drilling vessels to store large quantities of drilling fluids in order to reduce the dependency of drilling vessels on the supply of work boats during the drilling operation. Drilling fluid formulations are based on an analysis of geologic information gathered about or at the drilling site. Thus drilling fluids with the desired characteristics can be prepared for storage in the ballast compartment of a drilling vessel.

Once the drilling fluid is prepared, a period of predicted good weather is selected, preferably a period of at least two days of predicted good weather is selected. The drilling fluid is loaded on work boats and transported to the drilling vessel where the drilling fluid is pumped into the vessel's ballast tank compartments for storage. Keeping the platform balanced or trim during this operation is important and requires a careful monitoring of pump action and drilling fluid distribution.

Drilling vessel ballast tanks typically have multiple compartments on each side of the drilling vessel. Individual compartments are emptied of fluid and refilled with drilling fluid in a sequence and pattern to keep the drilling vessel balanced or trim.

When the drilling is ready to begin, the drilling fluid is pumped from the ballast tanks and mixed with optional ingredients, such as sized solid particulate material like calcium carbonate or barium sulfate, in the mixing tanks of the drilling vessel. Once again it is important that all the pumping operations be planned to keep the platform trim throughout the operation. The final drilling fluid formulation is then ready to be circulated through the wellbore during the drilling operation.

Drilling fluids are formulated to meet the requirements of the well site. For example, the density of the drilling fluid is designed to maintain the hydrostatic pressure within the wellbore to prevent shallow water flows. Fluid density is provided by dissolved solids, including without limitation the solid salts of sodium, potassium, calcium and zinc and the organic acetate and formate salts of sodium, potassium and cesium. A particular salt is selected to adjust the density of the drilling fluid based on environmental considerations, the required density, cost, and the freezing point of the required solution (highly concentrated solutions of certain salts have a high enough freezing point that they are subject to freezing in colder waters).

Furthermore, the drilling fluid should have sufficient carrying capacity to remove the bit cuttings from the wellbore. Materials used to adjust the carrying capacity of the drilling fluid include without limitation hydroxyethyl cellulose, welan gum, guar gum, xanthum gum, polyacrylamide/polyacrylate, or carboxymethyl cellulose.

Drillers often encounter zones that accept large volumes of drilling fluid due to fractures, coarse sand, gravel, or other formations. Severe losses in drilling fluid can be controlled by circulating high concentrations of sized solids suspended in viscous fluids or gels. Such mixtures are referred to as lost circulation materials. The lost circulation materials are designed to bridge and seal very permeable formations and to prevent fractures from growing. Appropriate water soluble viscosifiers or suspension agents for drilling fluids are xanthan gum and N-VIS™ HB (available from Baroid Drilling Fluids, Houston, Tex.). Suitable sized solid particulates include barium sulfate, calcium carbonate, iron carbonate, and hematite. Additional fluid loss control can be provided by starch derivatives, polyacrylates, amps polymers, and lignin based materials.

One major concern for drilling fluid that is to be stored in ballast tanks and used on a drilling vessel, is that any additional components that must be added to the drilling fluid during the drilling operation must be kept at a minimum. Since drilling vessels generally have limited mixing capacity, it is important to minimize the need for mixing additional materials. However, it is also important that drilling fluids to be stored in ballast tanks should not contain particulate material that could settle out of the drilling fluid, any sized solid particulate material such as barium sulfate, calcium carbonate, iron carbonate, or hematite must be mixed with the fluid on the drilling vessel before it is used during the drilling operation.

Yet another desirable feature of drilling fluid, suitable for ballast tank storage and use on a drilling vessel, is that the fluid be theologically stable and remain in a homogenous state while being stored. For example, the drilling fluid should provide a biostatic environment that would inhibit bacterial growth and the bacterial breakdown of certain drilling fluid components. Examples of brine-based drilling fluids suitable for ballast tank storage are set forth below. The examples given below are meant to be illustrative and not limiting.

EXAMPLE 1

Potassium Chloride Based Drilling Fluid

| Ingredients | Per barrel |
|---|---|
| 9.7 lb/gal saturated KCl brine | 1 bbl. |
| N-VIS ™* | 1 lb. |
| N-DRIL HT PLUS ™** | 4 lb. |
| LIQUI-VIS EP ™*** | 0.5 lb. |

*N-VIS ™ is an xanthan gum that provides increased suspension properties.
**N-DRIL HT PLUS ™ is an amylopectin preparation used as a fluid loss preventative.
***LIQUI-VIS EP ™ is a liquid hydroxyethyl cellulose.

N-VIS, N-DRIL HT PLUS, and LIQUI-VIS EP are trademarks of Baroid Drilling Fluids.

Characteristics of the Drilling Fluid in Example 1

| | Measurement | |
|---|---|---|
| Characteristics Measured | Test 1 | Test 2 |
| Stirred, min | 30 | 30 |
| Temperature, ° F. | 72 | 120 |
| Plastic viscosity, cP | 14 | 11 |
| Yield point, lb/100 ft. | 28 | 20 |
| 10 Sec gel, lb/100 ft. | 9 | 7 |
| 10 Min gel, lb/100 ft. | 12 | 11 |

-continued

| Characteristics Measured | Measurement Test 1 | Test 2 |
|---|---|---|
| pH | 7.6 | |
| API filtrate, ml | 6.8 | |
| Fann 35 dial readings | | |
| 600 rpm | 56 | 42 |
| 300 rpm | 42 | 31 |
| 200 rpm | 35 | 26 |
| 100 rpm | 26 | 20 |
| 6 rpm | 10 | 8 |
| 3 rpm | 9 | 7 |

EXAMPLE 2

| Sodium Chloride Based Drilling Fluid | |
|---|---|
| Ingredients | Per barrel |
| 10.0 lb/gal saturated NaCl brine | 1 bbl. |
| N-VIS ™* | 1 lb. |
| N-DRIL HT PLUS ™** | 4 lb. |
| LIQUI-VIS EP ™*** | 0.5 lb. |

*N-VIS ™ provide increased suspension properties.
**N-DRIL HT PLUS ™ is a fluid loss preventative.
***LIQUI-VIS EP ™ is a liquid hydroxy ethyl cellulose.

N-VIS, N-DRIL HT PLUS, and LIQUI-VIS EP are trademarks of Baroid Drilling Fluids.

Characteristics of the Drilling Fluid in Example 2

| Characteristics Measured | Measurement Test 1 | Test 2 |
|---|---|---|
| Stirred, min | 30 | 30 |
| Temperature, ° F. | 72 | 120 |
| Plastic viscosity, cP | 18 | 14 |
| Yield point, lb/100 ft. | 28 | 22 |
| 10 Sec gel, lb/100 ft. | 9 | 7 |
| 10 Min gel, lb/100 ft. | 11 | 11 |
| pH | 7.3 | |
| API filtrate, ml | 6.4 | |
| Fann 35 dial readings | | |
| 600 rpm | 64 | 50 |
| 300 rpm | 46 | 36 |
| 200 rpm | 38 | 29 |
| 100 rpm | 28 | 23 |
| 6 rpm | 10 | 9 |
| 3 rpm | 9 | 7 |

EXAMPLE 3

| Calcium Chloride Based Drilling Fluid | |
|---|---|
| Ingredients | Per barrel |
| 10.0 lb/gal saturated $CaCl_2$ brine | 1 bbl. |
| N-VIS ™* HB* | 1 lb. |
| N-DRIL HT PLUS ™** | 4 lb. |
| LIQUI-VIS EP ™*** | 0.5 lb. |

*N-VIS ™ provides increased suspension properties.
**N-DRIL HT PLUS ™ is a fluid loss preventative.
***LIQUI-VIS EP ™ is a liquid hydroxy ethyl cellulose.

N-VIS, N-DRIL HT PLUS, and LIQUI-VIS EP are trademarks of Baroid Drilling Fluids.

Characteristics of the Drilling Fluid in Example 3

| Characteristics Measured | Measurement Test 1 | Test 2 |
|---|---|---|
| Stirred, min | 30 | 30 |
| Temperature, ° F. | 72 | 120 |
| Plastic viscosity, cP | 38 | 27 |
| Yield point, lb/100 ft. | 22 | 18 |
| 10 Sec gel, lb/100 ft. | 6 | 6 |
| 10 Min gel, lb/100 ft. | 9 | 8 |
| pH | 5.8 | |
| API filtrate, ml | 3.8 | |
| Fann 35 dial readings | | |
| 600 rpm | 98 | 72 |
| 300 rpm | 60 | 45 |
| 200 rpm | 45 | 34 |
| 100 rpm | 28 | 22 |
| 6 rpm | 7 | 7 |
| 3 rpm | 6 | 6 |

EXAMPLE 4

| Calcium Bromide Based Drilling Fluid | |
|---|---|
| Ingredients | Per barrel |
| 14.2 lb/gal $CaBr_2$, brine | 1 bbl. |
| N-VIS ™ HB* | 1 lb. |
| N-DRIL HT PLUS ™** | 4 lb. |
| LIQUI-VIS EP ™*** | 0.5 lb. |

*N-VIS ™ HB provides increased suspension properties.
**N-DRIL HT PLUS ™ is an amylopectin preparation used as a fluid loss preventative.
***LIQUI-VIS EP ™ is a liquid hydroxy ethyl cellulose.

N-VIS HB, N-DRIL HT PLUS, and LIQUI-VIS EP are trademarks of Baroid Drilling Fluids.

Characteristics of the Drilling Fluid in Example 4

| Characteristics Measured | Measurement Test 1 | Test 2 |
|---|---|---|
| Stirred, min | 30 | 30 |
| Temperature, ° F. | 72 | 120 |
| Plastic viscosity, cP | 29 | 23 |
| Yield point, lb/100 ft. | 14 | 12 |
| 10 Sec gel, lb/100 ft. | 2 | 2 |
| 10 Min gel, lb/100 ft. | 4 | 3 |
| pH | 5.2 | |
| API filtrate, ml | 6.2 | |
| Fann 35 dial readings | | |
| 600 rpm | 72 | 58 |
| 300 rpm | 43 | 35 |
| 200 rpm | 32 | 25 |
| 100 rpm | 19 | 15 |
| 6 rpm | 4 | 3 |
| 3 rpm | 3 | 2 |

EXAMPLE 5

Sodium Formate Brine Based Drilling Fluid

| Ingredients | Per barrel |
|---|---|
| 11.1 lb/gal saturated sodium format brine | 1 bbl. |
| N-VIS ™* | 1 lb. |
| N-DRIL HT PLUS ™** | 4 lb. |
| Sodium hydroxide | 0.1 lb. |
| LIQUI-VIS EP ™*** | 0.5 lb. |

*N-VIS ™ provides increased suspension properties.
**N-DRIL HT PLUS ™ is a fluid loss preventative.
***LIQUI-VIS EP ™ is a liquid hydroxy ethyl cellulose.

N-VIS, N-DRIL HT PLUS, and LIQUI-VIS EP are trademarks of Baroid Drilling Fluids.

Characteristics of the Drilling Fluid in Example 5

| | Measurement | |
|---|---|---|
| Characteristics Measured | Test 1 | Test 2 |
| Stirred, min | 30 | 30 |
| Temperature, ° F. | 72 | 120 |
| Plastic viscosity, cP | 26 | 17 |
| Yield point, lb/100 ft. | 28 | 20 |
| 10 Sec gel, lb/100 ft. | 6 | 5 |
| 10 Min gel, lb/100 ft. | 8 | 7 |
| pH | 10.7 | |
| API filtrate, ml | 4.6 | |
| Fann 35 dial readings | | |
| 600 rpm | 80 | 54 |
| 300 rpm | 54 | 37 |
| 200 rpm | 40 | 28 |
| 100 rpm | 25 | 20 |
| 6 rpm | 7 | 6 |
| 3 rpm | 6 | 5 |

EXAMPLE 6

Potassium Formate Brine Based Drilling Fluid

| Ingredients | Per barrel |
|---|---|
| 13.1 lb/gal saturated Potassium format brine | 1 bbl. |
| N-VIS ™ HB* | 1 lb. |
| N-DRIL HT PLUS ™** | 4 lb. |
| Potassium hydroxide | 0.1 lb. |
| LIQUI-VIS EP ™*** | 0.5 lb. |

*N-VIS ™ HB provides increased suspension properties.
**N-DRIL HT PLUS ™ is a fluid loss preventative.
***LIQUI-VIS EP ™ is a liquid hydroxy ethyl cellulose.

N-VIS HB, N-DRIL HIT PLUS, and LIQUI-VIS EP are trademarks of Barold Drilling Fluids.

Characteristics of the Drilling Fluid in Example 6

| | Measurement | |
|---|---|---|
| Characteristics Measured | Test 1 | Test 2 |
| Stirred, min | 30 | 30 |
| Temperature, ° F. | 72 | 120 |
| Plastic viscosity, cP | 23 | 17 |
| Yield point, lb/100 ft. | 12 | 12 |
| 10 Sec gel, lb/100 ft. | 5 | 3 |

-continued

| | Measurement | |
|---|---|---|
| Characteristics Measured | Test 1 | Test 2 |
| 10 Min gel, lb/100 ft. | 7 | 5 |
| pH | 10.6 | |
| API filtrate, ml | 4.2 | |
| Fann 35 dial readings | | |
| 600 rpm | 58 | 46 |
| 300 rpm | 35 | 29 |
| 200 rpm | 27 | 21 |
| 100 rpm | 17 | 14 |
| 6 rpm | 6 | 4 |
| 3 rpm | 5 | 3 |

EXAMPLE 7

Sodium Bromide Based Drilling Fluid

| Ingredients | Per barrel |
|---|---|
| 12.7 lb/gal saturated NaBr brine | 1 bbl. |
| N-VIS ™* | 1 lb. |
| N-DRIL HT PLUS ™** | 4 lb. |
| LIQUI-VIS EP ™*** | 0.5 lb. |

*N-VIS ™ provides increased suspension properties.
**N-DRIL HT PLUS ™ is a fluid loss preventative.
***LIQUI-VIS EP ™ is a liquid hydroxy ethyl cellulose.

N-VIS, N-DRIL HT PLUS, and LIQUI-VIS EP are trademarks of Baroid Drilling Fluids.

Characteristic of the Drilling Fluid in Example 7

| | Measurement | |
|---|---|---|
| Characteristics Measured | Test 1 | Test 2 |
| Stirred, min | 30 | 30 |
| Temperature, ° F. | 72 | 120 |
| Plastic viscosity, cP | 18 | 13 |
| Yield point, lb/100 ft. | 27 | 21 |
| 10 Sec gel, lb/100 ft. | 6 | 5 |
| 10 Min gel, lb/100 ft. | 8 | 7 |
| pH | 6.2 | |
| API filtrate, ml | 3.6 | |
| Fann 35 dial readings | | |
| 600 rpm | 63 | 47 |
| 300 rpm | 45 | 34 |
| 200 rpm | 36 | 26 |
| 100 rpm | 25 | 19 |
| 6 rpm | 7 | 6 |
| 3 rpm | 6 | 5 |

Numerous modifications and variations in the process for storing, mixing and using drilling fluids on a drilling vessel and in the composition of the drilling fluid composition are possible in light of the above teachings. It is therefore understood that within the scope of the appended claims, the invention may be practiced other than as specifically described.

We claim:

1. A process for storing drilling fluids on a floating drilling vessel having at least one ballast tank, said process comprising:

(a) preparing a drilling fluid suitable for ballast tank storage, wherein said drilling fluid contains little or no particulate material, is rheologically stable, is able to provide density through dissolved solids, and is capable of suspending particulate matter that may be added in the drilling operation;

(b) transporting the drilling fluid to a floating drilling vessel having at least one ballast tank;

(c) pumping the drilling fluid into at least one ballast tank of the drilling vessel, where said drilling fluid provides a biostatic environment in the ballast tank; and (d) trimming the drilling vessel during the addition of the drilling fluid to the ballast tank, such that said vessel maintains balance for floating.

2. The process of claim 1, wherein the drilling fluid pumped into the ballast tank comprises brine, liquid hydroxyethyl cellulose, amylopectin or other fluid loss preventative, and xanthan or other compound or material for increasing suspension properties of the fluid.

3. The process of claim 1, wherein said drilling vessel is to be used for riserless drilling and at least about 10,000 bbls of drilling fluid or sufficient quantities of drilling fluid to completely drill the well are stored in the ballast tank or tanks.

4. A method for drilling a sub-sea well comprising:

(a) preparing a drilling fluid suitable for storage in a ballast tank, wherein said drilling fluid contains little or no particulate material and fluid density is provided at least in part by dissolved solids;

(b) transporting the drilling fluid to a floating drilling vessel having at least one ballast tank;

(c) pumping a quantity of the drilling fluid into said ballast tank or tanks of said drilling vessel while monitoring said pumping and distribution of said fluid into said tank or tanks so as to maintain balance of said vessel; and (d) pumping the drilling fluid from said ballast tank or tanks into the wellbore as it is being drilled while monitoring said pumping of said fluid from said tank so as to maintain balance of said vessel.

5. The method of claim 4, further comprising designing the drilling fluid based on an analysis of the geologic information gathered at the drilling site, such that said dissolved solids are selected from the group comprising solid salts of sodium, potassium, calcium, and zinc, and the organic acetate and formate salts of sodium, potassium and cesium, and a particular salt from said group is selected to adjust the density of the drilling fluid based on considerations comprising environmental considerations, the required density for drilling the well, temperature of the sea waters and freezing point of the fluid.

6. The method of claim 4, wherein the drilling fluid provides a biostatic environment in the ballast tank.

7. The method of claim 4, wherein about 10,000 to about 30,000 bbls are pumped into said ballast tank or tanks.

8. The method of claim 4, further comprising removing an amount of the drilling fluid from the ballast tank and mixing said amount of the drilling fluid with a particulate material before pumping the drilling fluid into the wellbore.

9. The method of claim 4 wherein said drilling is in deep water.

10. The method of claim 4 further comprising returning said drilling fluid to the sea floor.

11. The method of claim 4 wherein said drilling is riserless drilling.

12. The method of claim 4 wherein sufficient quantity of drilling fluid is transported to said vessel and pumped into said ballast tank or tanks such that said well may be drilled with such fluid without delays for additional fluid to be brought to said vessel.

13. A method of riserless drilling a sub-sea well from a floating drilling vessel having ballasts comprising:

(a) gathering geologic information about the drilling site and determining the required density or the density of the drilling fluid needed to maintain desired hydrostatic pressure within the wellbore during drilling to control shallow water flows;

(b) preparing a drilling fluid based on the geologic information gathered about the drilling site, such that at least some fluid density is provided by dissolved solids comprising salts selected to adjust the density of the drilling fluid;

(c) pumping at least about 10,000 bbls of the drilling fluid into at least one ballast tank of said drilling vessel while maintaining balance of said vessel for floating;

(d) removing an amount of the drilling fluid from the ballast tank while maintaining balance of said vessel for floating;

(e) admixing the drilling fluid with a particulate material; and (f) pumping the mixture of drilling fluid and particulate material into the wellbore as it is being drilled.

14. The method of claim 13 further comprising returning said drilling fluid to the sea floor.

15. The method of claim 13 wherein said salts are selected from the group comprising solid salts of sodium, potassium, calcium, and zinc, and the organic acetate and formate salts of sodium, potassium and cesium.

16. The method of claim 15 wherein said drilling fluid comprises liquid hydroxyethylcellulose, amylopectin, xanthan, and brine comprising said salts.

17. The method of claim 13 wherein said fluid is rheologically stable and remains in a homogeneous state during storage in said ballast tank compartment.

18. The method of claim 13 wherein said drilling fluid further comprises a material to provide or adjust the carrying capacity of the fluid to remove bit cuttings from the wellbore.

19. The method of claim 13 wherein said drilling fluid further comprises fluid loss control additives.

20. The method of claim 13 wherein said drilling is in deep water.

* * * * *